US008326180B2

(12) United States Patent
Fujiwara et al.

(10) Patent No.: US 8,326,180 B2
(45) Date of Patent: Dec. 4, 2012

(54) DEVELOPMENT DEVICE, PROCESS CARTRIDGE, AND IMAGE FORMING APPARATUS

(75) Inventors: Yoshihiro Fujiwara, Yokohama (JP); Yasuo Miyoshi, Yokohama (JP); Takuya Seshita, Hiratsuka (JP); Norio Kudo, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 266 days.

(21) Appl. No.: 12/709,022

(22) Filed: Feb. 19, 2010

(65) Prior Publication Data

US 2010/0215401 A1 Aug. 26, 2010

(30) Foreign Application Priority Data

Feb. 24, 2009 (JP) ..... 2009-040297

(51) Int. Cl.
*G03G 15/04* (2006.01)

(52) U.S. Cl. ..... 399/119; 399/254; 399/259; 399/272

(58) Field of Classification Search ..... 399/111, 399/119, 222, 252, 254, 258–260, 265, 267, 399/272, 276

See application file for complete search history.

(56) References Cited

U.S. PATENT DOCUMENTS

| | | | | |
|---|---|---|---|---|
| 6,259,876 | B1 * | 7/2001 | Fukuda et al. | 399/254 |
| 6,308,035 | B1 * | 10/2001 | Fukuda | 399/254 |
| 6,505,014 | B2 | 1/2003 | Aoki et al. | |
| 6,671,484 | B2 | 12/2003 | Miyoshi et al. | |
| 6,721,516 | B2 | 4/2004 | Aoki et al. | |
| 6,901,233 | B2 | 5/2005 | Aoki et al. | |
| 7,035,575 | B2 | 4/2006 | Ikeguchi et al. | |
| 7,496,324 | B2 | 2/2009 | Sugiura et al. | |
| 7,536,141 | B2 | 5/2009 | Miyoshi | |
| 7,599,649 | B2 | 10/2009 | Miyoshi | |
| 2004/0223779 | A1 * | 11/2004 | Satoh | 399/98 |
| 2007/0280744 | A1 * | 12/2007 | Kubo et al. | 399/269 |
| 2008/0056747 | A1 | 3/2008 | Miyoshi | |
| 2008/0145107 | A1 | 6/2008 | Miyoshi | |
| 2009/0169264 | A1 | 7/2009 | Miyoshi et al. | |
| 2009/0232558 | A1 | 9/2009 | Kudo et al. | |
| 2009/0238610 | A1 | 9/2009 | Miyoshi et al. | |

FOREIGN PATENT DOCUMENTS

| | | |
|---|---|---|
| JP | 2003-263012 | 9/2003 |
| JP | 4093677 | 3/2008 |

OTHER PUBLICATIONS

U.S. Appl. No. 12/700,834, filed Feb. 5, 2010, Miyoshi, et al.

* cited by examiner

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A development device to develop a latent image with two-component developer includes a developer carrier disposed facing the image carrier, to carry the developer, a magnetic field generator disposed inside the developer carrier, to form multiple magnetic poles around the developer carrier, an interior wall dividing the interior of the development device into a first transport chamber and a second transport chamber parallel to the first transport chamber, a first transport member disposed in the first transport chamber, facing the developer carrier, to supply the developer to the developer carrier while transporting the developer longitudinally, a second transport member disposed in the second transport chamber, facing the developer carrier, to transport the developer separated from the developer carrier longitudinally, a partition disposed between the developer carrier and the second transport member to prevent resupply of the used developer in the second transport chamber from to the developer carrier.

17 Claims, 9 Drawing Sheets

DEVELOPMENT DEVICE, PROCESS CARTRIDGE, AND IMAGE FORMING APPARATUS

CROSS-REFERENCE TO RELATED APPLICATIONS

This patent specification is based on and claims priority from Japanese Patent Application No. 2009-040297, filed on Feb. 24, 2009 in the Japan Patent Office, which is hereby incorporated by reference herein in its entirety.

BACKGROUND OF THE INVENTION

1. Field of the Invention

The present invention generally relates to a development device, a process cartridge, and an image forming apparatus such as a copier, a printer, a facsimile machine, or a multifunction machine capable of at least two of these functions and which includes the development device.

2. Discussion of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer. In electrophotographic images forming apparatuses, two-component developer consisting essentially of toner and carrier particles is widely used.

Development devices using two-component developer (hereinafter "two-component development devices") are typically configured to include a developer carrier (e.g., development roller) to carry the developer thereon, multiple developer transport chambers (e.g., a developer containing part) extending in a longitudinal direction of the development device, and multiple developer transport members to transport the developer within the multiple developer transport chambers, thus circulating the developer inside the development device. The multiple developer transport chambers include a developer supply chamber, from which the developer is supplied to a circumferential surface of the developer carrier, and a collection chamber, to which the developer that has been used in image development is collected from the circumferential surface of the developer carrier. These developer transport chambers are separated partially or entirely by a wall or partition.

At least two of the multiple developer transport members are often arranged vertically because this arrangement can make the development device horizontally compact compared with an arrangement in which the multiple developer transport members are arranged horizontally. In particular, this arrangement is widely used in tandem-type multicolor image forming apparatuses that include multiple development devices arranged horizontally.

Multiple magnets are fixed inside the developer carrier to form corresponding multiple magnetic poles around the developer carrier. The multiple magnetic poles include an attraction pole to attract the developer to the circumferential surface of the developer carrier, a development pole that contributes to image development, and a release pole that contributes to separating the developer from the developer carrier after image development.

In two-component development devices, fresh toner is supplied to the development device as the toner therein is consumed in image development. The supplied toner is mixed with the developer in the development device by the developer transport member (e.g., a transport screw), and then the mixed developer is partly supplied to the circumferential surface of the developer carrier. While the developer carrier rotates, a doctor blade serving as a developer regulator adjusts the amount of the developer carried on the surface of the developer carrier, and then the toner in the two-component developer is adhered to a latent image formed on an image carrier in a development range or area where the development roller faces the image carrier.

In such two-component development devices, because the concentration of toner in the developer that has been used in image development (hereinafter "used developer") is lower than that which has not been used in image development, image density can be reduced or become uneven if such used developer is again supplied to the developer carrier.

In view of the foregoing, several approaches, described below, have been tried to prevent the used developer from being supplied to the developer carrier.

For example, in certain known development devices, the developer supply chamber (e.g. a first developer transport chamber) is positioned above the developer collection chamber (e.g., second developer transport chamber). The developer transport member (e.g., a first developer transport member) disposed in the developer supply chamber supplies the developer to the development roller at a position corresponding to the attraction pole (hereinafter "attraction position") while transporting the developer within the developer supply chamber longitudinally within the developer carrier of the development device. Then, the developer is separated from the development roller at a position corresponding to the release pole (hereinafter "release position") and is collected in the developer collection chamber in which the developer transport member (e.g., a second developer transport member) transports the developer in a direction opposite the direction in which the first developer transport member transports the developer (hereinafter "developer circulation direction").

Although in the above-described configuration the first developer transport chamber and the second developer transport chamber are separated, a downstream portion of the first developer transport chamber and an upstream portion of the second developer transport chamber in the developer circulation direction communicate with each other through a first communication portion, and the developer falls under its own weight through the first communication portion from the first developer transport chamber to the second developer transport chamber. Similarly, an upstream portion of the first developer transport chamber and a downstream portion of the second developer transport chamber in the developer circulation direction communicate with each other through a second communication portion.

The mixture including the developer separated from the development roller, that which has fallen through the first communication portion, and that transported from the upstream portion of the second developer transport chamber accumulates in the downstream portion of the second developer transport chamber in the developer circulation direction and then is pushed up by the pressure of the accumulation through the second communication portion to the upstream portion of the first developer transport chamber.

Vertically arranging the developer supply chamber and the developer collection chamber can better inhibit the used developer from being resupplied to the development roller compared with the arrangement in which multiple developer transport members are arranged horizontally. Accordingly, unevenness in the amount of toner forming a toner image on the image carrier can be reduced.

However, in this known configuration, it can still happen that the developer used in image development and then separated form the development roller at the release position might be again carried on the development roller by rotation of the second developer transport member, a phenomenon which is hereinafter referred to as "resupply of used developer". If resupply of used developer occurs, the used developer having a reduced toner concentration is supplied to the development roller, making the image density uneven.

Occurrence of resupply of used developer is more frequent in the downstream portion of the second developer transport chamber, adjacent to the second communication portion, where the amount (height) of accumulated developer is greater. In particular, resupply of used developer occurs more often when the dimensions of the second developer transport chamber are reduced to make the development device more compact. More specifically, when the dimensions of the second developer transport chamber are smaller, the developer occupies proportionally more of the second developer transport chamber, and accordingly, resupply of used developer can occur more easily. Additionally, unevenness in the image density can also be significant when the second communication portion is disposed closer to the development range, because the used developer carried again on the development roller is immediately used in image development if resupply of used developer occurs.

In another approach, the wall dividing the two vertically arranged developer transport chambers is extended to an contact the development roller and functions as a developer separation member to remove the developer mechanically from the circumferential surface of the development roller.

Although this known configuration is successful in removing the resupplied used developer mechanically from the development roller even if the developer separated from the development roller at the release position is again carried on the development roller, the developer separation member being in contact with the development roller can increase the wear on the development roller as well as the driving torque of the development device, which is not desirable.

In view of the foregoing, in development devices including two vertically arranged developer transport chambers in which developer is transported in the longitudinally within the development device, there is a need to prevent carrying over of the developer without increasing the wear of the developer carrier, which the known image forming apparatuses fail to do.

SUMMARY OF THE INVENTION

In view of the foregoing, one illustrative embodiment of the present invention provides a development device to develop a latent image formed on an image carrier with two-component developer consisting essentially of toner and magnetic carrier particles.

The development device includes a developer carrier disposed facing the image carrier, to carry the developer by rotation, a magnetic field generator disposed inside the developer carrier, to form multiple magnetic poles around the developer carrier, an interior wall dividing the interior of the development device into a first transport chamber and a second transport chamber parallel to the first transport chamber, a first developer transport member disposed in the first transport chamber, facing the developer carrier, a second developer transport member disposed in the second transport chamber, facing the developer carrier, and a partition disposed between the developer carrier and the second transport member to prevent the developer in the second transport chamber from being supplied to the developer carrier. The first developer transport member and the second developer transport member transport the developer longitudinally within the development device and together form a circulation path through which the developer is circulated inside the development device. The first transport member supplies the developer to the developer carrier, and the second transport member transports the developer separated from the developer carrier in the longitudinal direction.

Another illustrative embodiment of the present invention provides a process cartridge that is removably installable in an image forming apparatus. The process cartridge includes the development device described above and an image carrier on which a latent image is formed.

Yet another illustrative embodiment of the present invention provides an image forming apparatus that includes an image carrier on which a latent image is formed, a charging member disposed adjacent to the image carrier, to charge a surface of the image carrier, a writing unit to direct an optical beam according to image date to the surface of the image carrier, forming a latent image thereon, and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
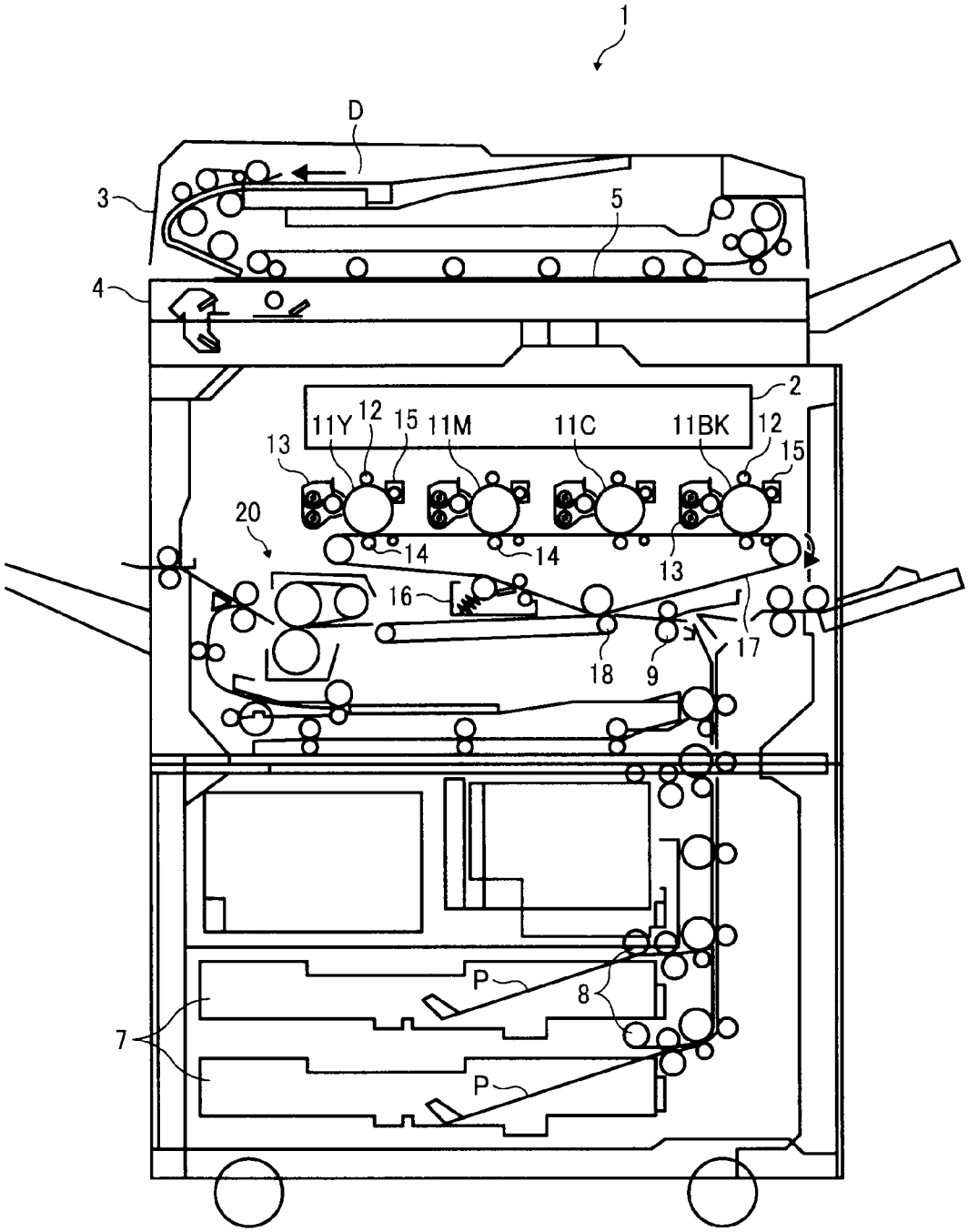
FIG. 1 is a schematic diagram illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. Referring now to the drawings, wherein like reference numerals designate identical or corresponding parts throughout the several views thereof, and particularly to FIG. 1, a multicolor image forming apparatus according to an illustrative embodiment of the present invention is described.

FIG. 1 is a schematic diagram illustrating a configuration of a tandem multicolor image forming apparatus 1.

It is to be noted that the subscripts Y, M, C, and BK attached to the end of each reference numeral indicate only that components indicated thereby are used for forming yellow, magenta, cyan, and black images, respectively, and hereinafter may be omitted when color discrimination is not necessary.

In FIG. 1, reference number 2 represents a writing unit to emit laser beams according to image data, 3 represents a document feeder to send an original document D to a document reading unit 4 that reads image data of the original document D, 7 represents a sheet cassette containing sheets P of recording media, 8 represents feed rollers, 9 represents a pair of registration rollers to adjust the timing to transport the sheet P, 11 represents photoconductor drums serving as image carriers on which yellow, magenta, cyan, and black toner images are formed, respectively, 12 represents charging members to charge surfaces of the respective photoconductor drums 11, 13 represents development devices to develop electrostatic latent images formed on the respective photoconductor drums 11, 14 represents primary-transfer bias rollers to transfer toner images formed on the respective photoconductor drums 11 onto an intermediate transfer belt 17, and 15 represents cleaning units to clean the surfaces of the respective photoconductor drums 11.

Additionally, reference number 16 represents a belt cleaning unit to clean a surfaces of the intermediate transfer belt 17, 18 represents a secondary-transfer bias roller to transfer the toner image from the intermediate transfer belt 17 onto the sheet P, and 20 represents a fixing device to fix the toner image on the sheet P. Additionally, toner containers 28 (shown in FIG. 2) respectively containing yellow, cyan, magenta, and black toners to be supplied to the respective development devices 13 are provided above the photoconductors 11 although not shown in FIG. 1.

Figure 2:
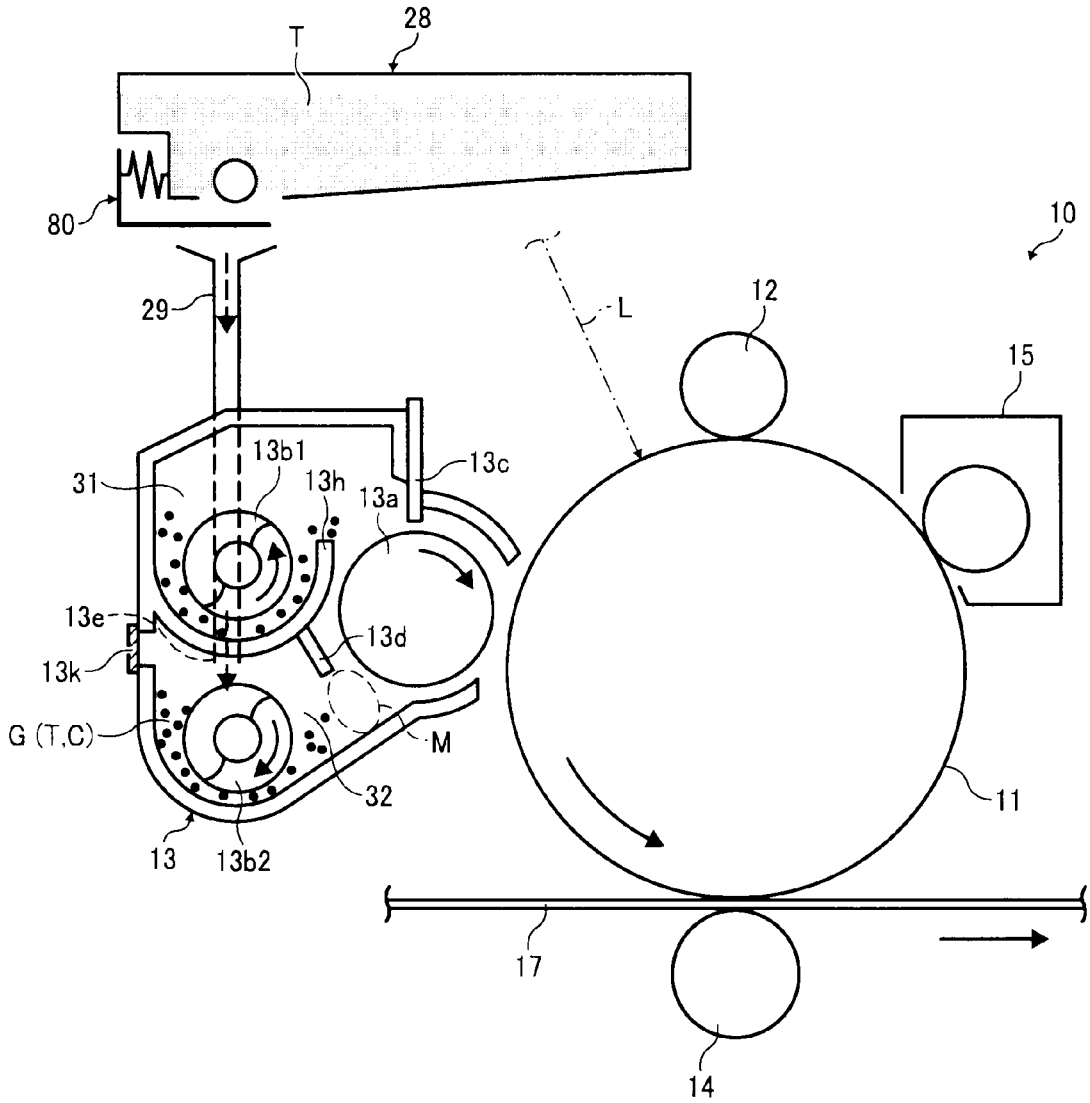
FIG. 2 is a schematic diagram illustrating a configuration of an image forming unit included in the image forming apparatus shown in FIG. 1.

Operations of the image forming apparatus 1 shown in FIG. 1 to form multicolor images are described below. It is to be noted that FIG. 2 is also referred to when image forming process performed on the respective photoconductor drums 11 are described.

In the document feeder 3, transport rollers, not shown, transport original documents D set on a document table, not shown, in a direction indicated by an arrow onto a contact glass 5 of the document reading unit 4. Then, the document reading unit 4 reads image data of the original document D set on the contact glass 5 optically.

More specifically, the document reading unit 4 scans the image in the original document D with light emitted from an illumination lamp, not shown. The light reflected by a surface of the original document D is imaged on a color sensor via mirrors and lenses, not shown. The color sensor reads the multicolor image data of the original document D for each decomposed colors of red, green, and blue (RGB) and convert the image data into electrical image signals. Further, the image signals are transmitted to an image processor, not shown, that performs image processing (e.g., color conversion, color calibration, and spatial frequency adjustment) according to the image signals, and thus image data of yellow, magenta, cyan, and black is obtained.

The yellow, magenta, cyan, and black single-color image data is then transmitted to the writing unit 2, and the writing unit 2 directs laser beams L (shown in FIG. 2) corresponding to the single-color image data to the respective photoconductor drums 11.

Meanwhile, the four photoconductor drums 11 rotate clockwise in FIG. 1. Initially, the surface of each photoconductor drum 11 is charged uniformly by the charging member 12 at a position facing the charging member 12 to a predetermined or given charge electrical potential, which is referred to as a charging process. When the surface of the photoconductor drums 11 reach positions to receive the laser beams L, respectively, the writing unit 2 directs the laser beams L according to the respective color image date, emitted from four light sources (not shown), to the respective photoconductor drums 11, which is referred to as an exposure process. The four laser beams L pass through different optical paths for yellow, magenta cyan, and black.

The laser beam L corresponding to the yellow component is directed to the photoconductor drum 11Y, which is the first from the left in FIG. 1 among the four photoconductor drums 11. A polygon mirror, not shown, that rotates at high velocity deflects the laser beam L for yellow in a direction of a rotation axis of the photoconductor drum 11Y (main scanning direction) so that the laser beam L scans the surface of the photoconductor drum 11Y. Thus, an electrostatic latent image for yellow is formed on the photoconductor drum 11 charged by the charging member 12.

Similarly, the laser beam L corresponding to the magenta component is directed to the surface of the photoconductor drum 11M, which is the second from the left in FIG. 1. The laser beam L corresponding to the cyan component is directed to the surface of the photoconductor drum 11C, which is the third from the left in FIG. 1. The laser beam L corresponding to the black component is directed to the surface of the photoconductor drum 11BK that is the fourth from the left in FIG. 1. Thus, electrostatic latent images for magenta, cyan, and black are formed on the photoconductor drum 11M, 11C, and 11BK, respectively.

Then, each photoconductor drum 11 reaches a position facing the development device 13, and the development device 13 supplies toner of the corresponding color to the photoconductor drum 11. Thus, the latent images on the respective photoconductor drums 11 are developed into different single-color toner images in a development process. Then, each photoconductor drum 11 reaches a position facing the intermediate transfer belt 17 where the primary transfer roller 14 is disposed in contact with an inner circumferential surface of the intermediate transfer belt 17. At these positions, the toner images formed on the respective photoconductor drums 11 are sequentially transferred and superimposed one on another on the intermediate transfer belt 17, forming a multicolor toner image thereon, in a primary transfer process. After the primary transfer process, the surface of each photoconductor drum 11 reaches a position facing the cleaning unit 15, where the cleaning unit 15 collects any toner remaining on the photoconductor drum 11 in a cleaning process. Additionally, the surface of each photoconductor drum 11 passes through a discharge device, not shown, and thus a sequence of image forming processes performed on each photoconductor drum 11 is completed.

Meanwhile, the intermediate transfer belt 17 carrying the multicolor toner image further rotates clockwise in FIG. 1 to a secondary transfer nip where the secondary-transfer bias roller 18 presses against the intermediate transfer belt 17, and then the multicolor toner image is transferred from the intermediate transfer belt 17 onto the sheet P in a secondary transfer process. After the secondary transfer process, the intermediate transfer belt 17 reaches a position facing the belt cleaning unit 16, where any toner remaining on the intermediate transfer belt 20 is collected by the belt cleaning unit 16. Thus, a sequence of image forming processes performed on the intermediate transfer belt 17 is completed.

Herein, sheets P are transported from one of the sheet cassettes 7 via the registration rollers 9, etc., to the secondary transfer nip formed between the intermediate transfer belt 17 and the secondary-transfer bias roller 18. More specifically, the feed roller 8 sends out the sheet P from the sheet cassette 7, and the sheet P is then guided by a sheet guide, not shown, to the registration rollers 9. The registration rollers 9 forward the sheet P to the secondary transfer nip, timed to coincide with the arrival of the multicolor toner image formed on the intermediate transfer belt 17.

Then, a transport belt, not shown, transports the sheet P to the fixing device 20, and the toner image is fixed on the sheet P in a nip where a fixing belt and a pressure roller, not shown, of the fixing device 20 press against each other. After the fixing process, discharge rollers, not shown, discharge the sheet P as an output image outside the image forming apparatus 1. Thus, a sequence of image forming processes is completed.

Next, image forming units are described below with reference to FIG. 2.

FIG. 2 illustrates an image forming unit 10 and the toner container 28. It is to be noted that the four image forming units 10 and the four toner containers 28 have similar configurations, and thus the subscripts Y, C, M, and BK are omitted in the drawings for simplicity.

As shown in FIG. 2, each image forming unit 10 includes the photoconductor drum 11, the charging member 12, the development device 13, the cleaning unit 15, and the like. The photoconductor drum 11 in the present embodiment is a negatively-charged organic photoconductor having an external diameter of about 30 mm and is rotated counterclockwise in FIG. 2 by a driving unit, not shown.

The charging member 12 is an elastic charging roller and can be formed by covering a metal core with an elastic layer of moderate resistivity. For example, the elastic layer of moderate resistivity can be a foamed urethane layer including carbon black as electroconductive particles, sulfurizing agent, foaming agent, and the like. The material of the elastic layer of moderate resistivity include, but not limited to, rubber such as urethane, ethylene-propylene-diene (EPDM), acrylonitrile butadiene rubber (NBR), silicone rubber, and isoprene rubber to which electroconductive material such as carbon black or metal oxide is added to adjust the resistivity. Alternatively, foamed rubber including these materials may be used. The cleaning unit 15 includes a cleaning brush or cleaning blade that slidingly contacts the surface of the photoconductor drum 11 and removes any toner adhering to the photoconductor drum 11 mechanically.

The development device 13 contains two-component developer (developer particles) G consisting essentially of toner T and carrier particles C with which the development device 13 develops the latent image formed on the photoconductor drum 11 into a toner image. The development device 13 includes a development roller 13*a* serving as a developer carrier, disposed close to the photoconductor drum 11, first and second transport screws 13*b*1 and 13*b*2 (screw augers), serving as transport members, and a doctor blade 13*c* serving as a developer regulator.

It is to be noted that an interior wall 13*h* of the development device 13 separates a first transport chamber or supply chamber 31 in which the first transport screw 13*b*1 is disposed from a second transport chamber or collection chamber 32 in which the second transport screw 13*b*2 is disposed. The first and second transport chambers 31 and 32 contain the developer. In the configuration shown in FIG. 2, the interior wall 13*h* is partly rounded to enclose the first transport screw 13*b*1 and is also referred to as a jaw-like portion of the first transport chamber 31. The development device 13 further includes a partition 13*d* (shown in FIG. 6) configured to extend from the interior wall 13*h* between the development roller 13*a* and the second transport screw 13*b*2. A development area or development nip where a magnetic brush formed on the development roller 13*a* contacts the surface of the photoconductor drum 11 is formed in the portion where the development roller 13*a* faces the photoconductor drum 11.

In FIG. 2, reference character 13*k* represents an air discharge port, and M represents an opening formed in the second transport chamber 32.

Referring to FIG. 2, the toner container 28 contains the toner T to be supplied to the development device 13. For example, the toner container 28 includes a shutter 80, and a controller (not shown) of the image forming apparatus 1 shown in FIG. 1 causes a shutter driving unit (not shown) to open and close the shutter 80 according to toner concentration, which is the ratio of the toner T in the developer G, detected by a magnetic sensor (not shown) provided in the development device 13, thus supplying the toner T from the toner container 28 to the development device 13 as required.

It is to be noted that the data according to which the toner T is supplied is not limited to the toner concentration, and alternatively, the toner T may be supplied according to toner consumption. For example, toner consumption may be determined based on the image density calculated from the reflectance of the toner image formed on the photoconductor drums 11 or the intermediate transfer belt 17. Yet alternatively, the toner may be supplied according to a combination of such data. A supply tube 29 connects together the toner container 28 and the development device 13 to guide the toner T discharged from the tone container 28 so that the toner T can be reliably supplied to the development device 13 through a supply port 13*e* formed in the development device 13.

Figure 3:
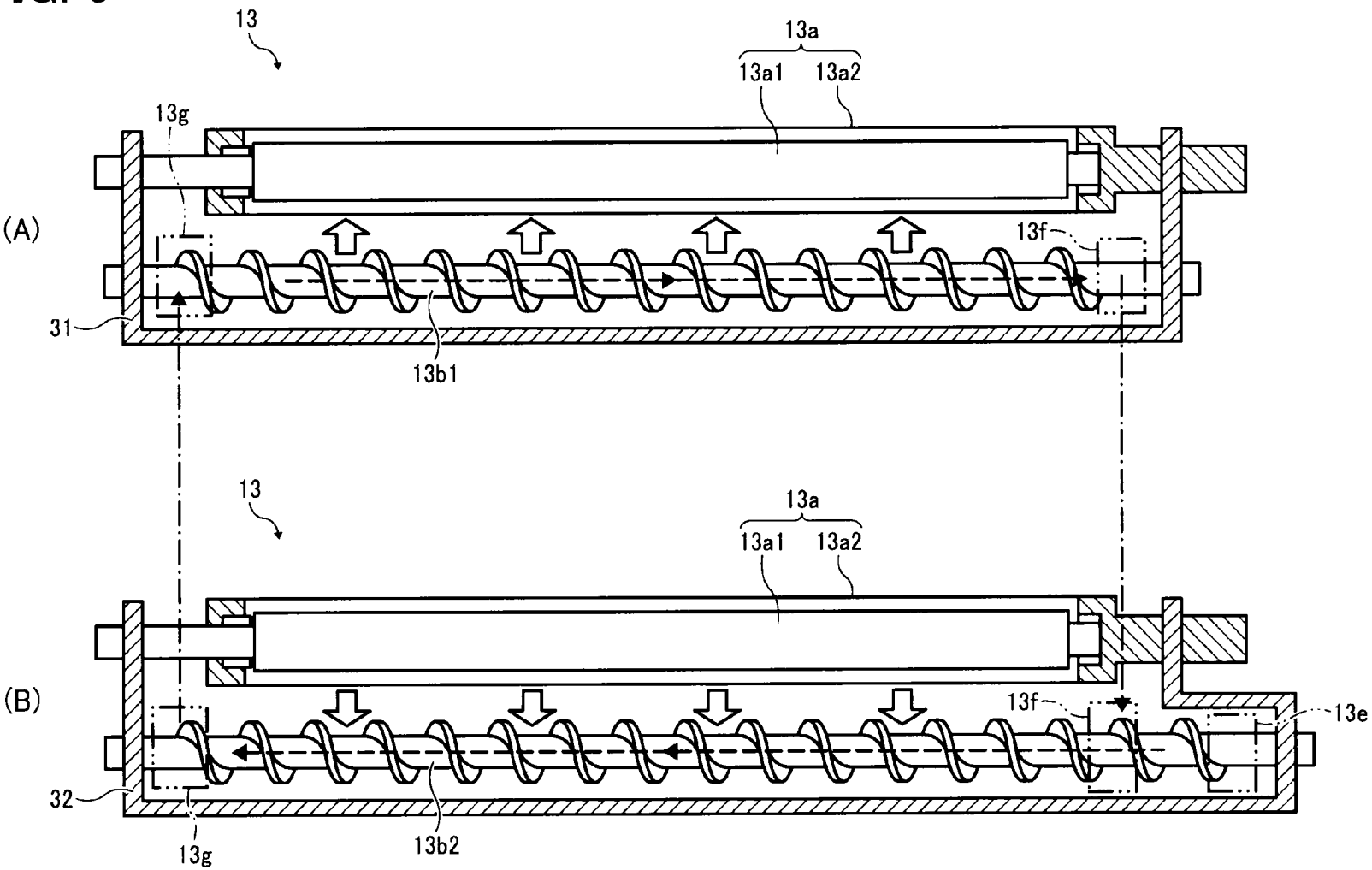
FIG. 3 schematically illustrates horizontal cross sections of the development device shown in FIG. 2, viewed in the longitudinal direction, and (A) and (B) respectively illustrate an upper portion and a lower portion of the development device in a longitudinal direction.

FIG. 3 schematically illustrates horizontal cross sections of the development device 13, and (A) and (B) respectively illustrate an upper portion (first transport chamber 31) and a lower portion (second transport chamber 32) of the development device 13 in a longitudinal direction of the development device 13.

Referring to FIG. 3, the development roller 13*a* has a reduced diameter, for example, not greater than 14 mm, and includes a sleeve 13*a*2 and a magnet roller 13*a*1, serving as a magnetic field generator, provided inside the sleeve 13*a*2. Although the sleeve 13*a*2 is cylindrical in the present embodiment, alternatively, the sleeve 13*a*2 may be a polygonal prism.

Although the first transport chamber 31 and the second transport chamber 32 are separated, a downstream portion of the first transport chamber 31 communicates with an upstream portion of the second transport chamber 32 through a first communication port 13*f*, and a downstream portion of the second transport chamber 32 communicates with an upstream portion of the first transport chamber 31 through a second communication port 13*g*, serving as a communication port, in a direction in which the developer G is circulated in the development device 13 (hereinafter "developer circulation direction"). Both the first communication port 13*f* and the second communication port 13*g* are formed in the interior wall 13*h*.

The sleeve 13*a*2 can be formed with nonmagnetic material such as aluminum, brass, stainless steel, or conductive resin and is rotated clockwise in FIG. 2 by a driving unit, not shown.

The magnet roller 13*a*1 whose position is fixed relative to the development device 13 generates multiple magnetic poles, namely, a main pole H1, a transport pole H2, a release pole H3, and an attraction pole H4 (shown in FIG. 5), around a circumferential surface of the sleeve 13*a*2. It is to be noted that reference characters S and N enclosed in brackets shown in FIG. 5 represent south pole or north pole, respectively, as the polarity of the magnetic poles H1 through H4.

While rotating in the direction indicated by the arrow shown in FIG. 2, the development roller 13*a* transports the developer G carried on its circumferential surface to a position facing the doctor blade 13*c* (hereinafter "doctor gap"), where the amount of the developer G is adjusted, and further transports it to the development area facing the photoconductor drum 11. Then, the toner in the developer G adheres to the latent image formed on the photoconductor drum 11 due to the effect of the magnetic field generated in the development area.

Figure 4:
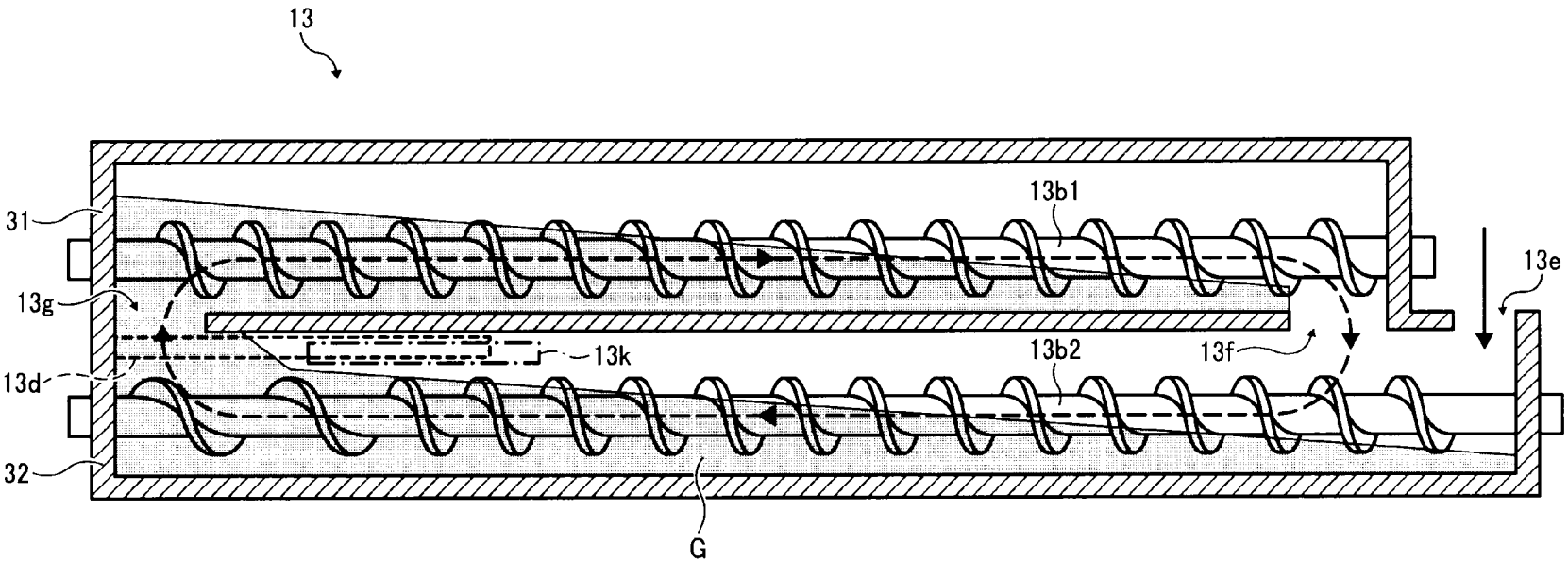
FIG. 4 illustrates a vertical cross section of the development device shown in FIG. 3, viewed in the longitudinal direction.

FIG. 4 illustrates a vertical cross section of the development device 13 in the longitudinal direction. FIG. 5 illustrates distribution of the magnetic force exerted by the magnetic poles H1 through H4 in a cross section of the development device 13 in an upstream portion of the second transport chamber 32 in the developer circulation direction.

Figure 5:
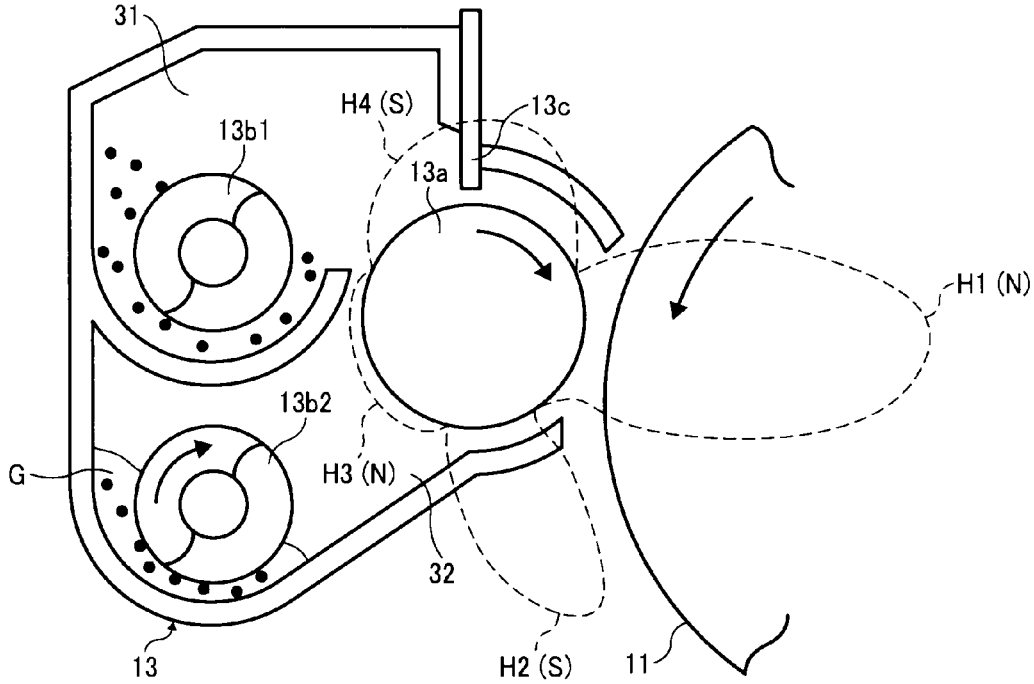
FIG. 5 illustrates distribution of magnetic force exerted by multiple magnetic poles formed around a development roller.

As shown in FIG. 5, the main pole H1 is disposed in the portion facing the photoconductor drum 11, the transport pole H2 is disposed downstream from the main pole H1 in a direction in which the development roller 13*a* (sleeve 13*a*2) rotates (hereinafter "rotational direction of the development roller 13*a*") and partly overlaps an interior wall of the second transport chamber 32. The release pole H3 is disposed above the transport pole H2, downstream from the transport pole H2 in the rotational direction of the development roller 13*a*. The attraction pole H4 extends from a position facing the first transport screw 13*b*1 to a position adjacent to the doctor blade 13*c*. The attraction pole H4 also serves as a developer regulation pole.

Initially, at a position where the magnetic force of the attraction pole H4 acts on the magnetic carrier particles in the developer G (hereinafter "attraction position"), the developer G contained in the first transport chamber 31 is carried on the development roller 13*a*. Then, at a predetermined or given position in the area where the magnetic force exerted by the attraction pole H4 acts on the developer G, the doctor blade 13*c* scrapes off the developer G partly from the circumferential surface of the development roller 13*a* to adjust the amount of the developer G carried thereon, and the scraped developer G is returned to the first transport chamber 31.

The developer particles G that have passed through the doctor gap between the doctor blade 13*c* and the circumferential surface of the development roller 13*a* stand on end on the development roller 13*a* due to the magnetic force exerted by the main pole H1, forming a magnetic brush in the development area and slidingly contact the surface of the photoconductor drum 11. Thus, the toner T in the developer G carried on the development roller 13*a* adheres to the latent image formed on the photoconductor drum 11. The developer G that has passed through the development area is kept on the development roller 13*a* by the magnetic force exerted by the transport pole H2 and is transported to the position corresponding to the release pole H3. Then, at a position corresponding to the release pole H3 (hereinafter "release position"), magnetic repulsion acts on the carrier particles, and thus the developer G used in the development process leaves the development roller 13*a*. Then, the developer G falls into the second transport chamber 32 and transported downstream by the second transport screw 13*b*2 therein.

The first transport screw 13*b*1 and the second transport screw 13*b*2 agitate and mix the developer G contained in the development device 13 while transporting the developer G horizontally in the longitudinal direction or the axial direction, perpendicular to the surface of paper on which FIG. 2 is drawn. The first transport screw 13*b*1 is disposed facing the development roller 13*a* and supplies the developer G to the development roller 13*a* as indicated by hollow arrows shown in (A) of FIG. 3 at the attraction position corresponding to the attraction pole H4 shown in FIG. 5 while transporting the developer G to the right in FIG. 3 in the first transport chamber 31 as indicated by a broken arrow shown in (A) of FIG. 3.

The first and second transport screws 13*b*1 and 13*b*2 are disposed so that their axes of rotation are substantially horizontal similarly to the development roller 13*a* and the photoconductor drum 11. Each of the first and second transport screws 13*b*1 and 13*b*2 are formed with a screw shaft and a bladed screw spiral having an external diameter of 16 mm or less and winding around the screw shaft. The second transport screw 13*b*2 is disposed beneath the first transport screw 13*b*1 and faces the development roller 13*a*.

The developer G that has been used in image development and has left the development roller 13*a* is collected in the second transport chamber 32 as indicated by hollow arrows shown in (B) of FIG. 3, forcibly separated from the development roller 13*a* due to the magnetic force of the release pole H3 shown in FIG. 5 and is then transported by the second transport screw 13*b*2 to the left in the second transport chamber 32 as indicated by a broken arrow shown in (B) of FIG. 3. It is to be noted that, in the present embodiment, the second transport screw 13*b*2 is configured to rotate in the direction identical to the rotational direction of the development roller 13*a*, that is, clockwise in FIG. 2.

Further, the developer G that is not supplied to the development roller 13*a* by the first transport screw 13*b*1 falls under gravity from the downstream portion of the first transport chamber 31 to the upstream portion of the second transport chamber 32 through the first communication port 13*f* as indicated by a downward broken arrow shown in FIG. 3. The developer G accumulates in the downstream portion of the second transport chamber 32, and the developer G thus piled up is sent from the downstream portion of the second transport chamber 32 to the upstream portion of the first transport chamber 31 through the second communication port 13*g* as indicated by an upward broken arrow shown in FIG. 3 in the developer circulation direction.

With this configuration, the first and second transport screws 13*b*1 and 13*b*2 forms a circulation path through which the developer G is circulated in the development device 13 is formed. That is, when the development device 13 is activated, the developer G contained therein flows in the developer circulation direction indicated by the broken arrows shown in FIGS. 3 and 4. Separating the supply chamber 31 from which the developer is supplied to the development roller 13*a* from the collection chamber 32 to which the developer G that has left the development roller 13*a* is collected can reduce unevenness in the amount of toner forming the toner image (image density) on the photoconductor drum 11.

It is to be noted that the magnetic sensor (not shown) to detect the toner concentration in the developer circulated in the development device 13 is disposed in the collection chamber (second transport chamber) 32. Based on the toner concentration detected by the magnetic sensor, the fresh toner T is supplied from the toner container 28 to the development device 13 through the supply port 13*e* disposed adjacent to the first communication port 13*f* in the collection chamber 32.

Additionally, referring to FIGS. 3 and 4, the supply port 13*e* is formed in an upper portion in the upstream portion of the collection chamber 32, in which the second transport screw 13*b*2 is disposed, outside the development area, that is, the area occupied by the development roller 13*a* in the longitudinal direction. It the configuration shown in FIGS. 3 and 4, the first supply chamber 31 is shorter in the longitudinal direction than the collection chamber 32, and the supply port 13*e* is disposed outside the first transport chamber 31 in the longitudinal direction. That is, the supply port 13*e* is disposed outside the first communication port 13*f* in the longitudinal direction.

Disposing the supply port 13*e* close to the first communication port 13*f* can attain effects that the used developer that has left the development roller 13*a* can fall on the supplied toner whose specific gravity is smaller and the mixture is transported downstream in the collection chamber 32 for a relatively long time. Accordingly, the supplied toner can be better dispersed in the developer. It is to be noted that the position of the supply port 13*e* is not limited to inside the collection chamber 32 but can be in an upper portion in the upstream portion of the supply chamber 31, for example.

Specific features of the development device 13 according to the present embodiment are described below.

Figure 6:
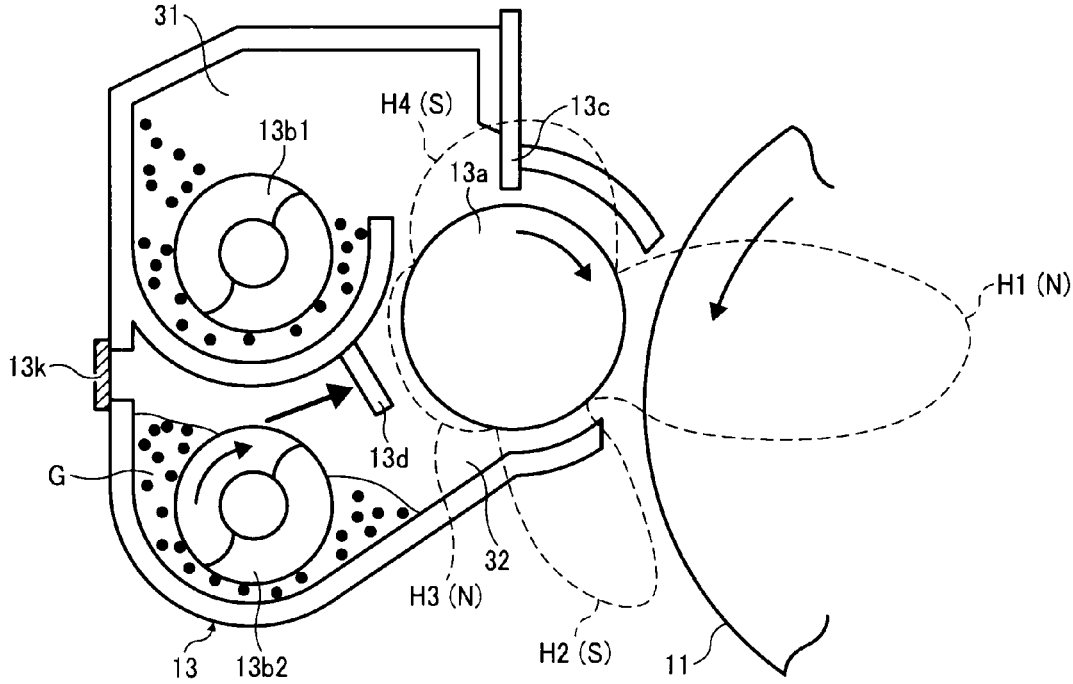
FIG. 6 illustrates a cross section of the development device in a downstream portion of a second transport path.
Figure 7:
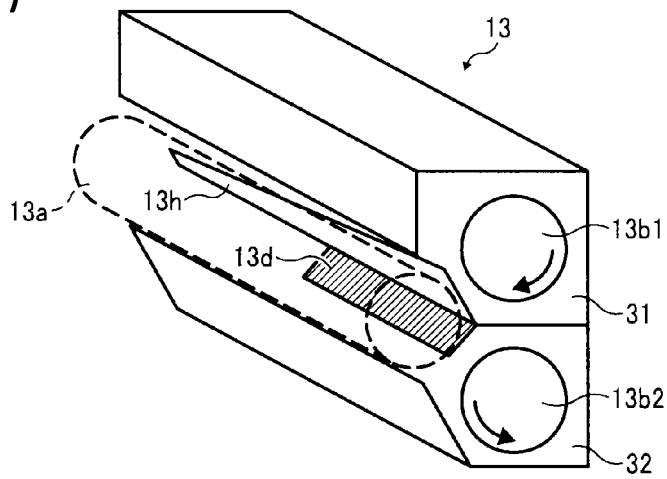
FIG. 7 is a schematic perspective diagram illustrating a configuration of the development device shown in FIG. 2.

FIG. 6 illustrates a cross section of the development device 13 in the downstream portion of the second transport chamber (collection chamber) 32. FIG. 7 is a perspective view of the development device 13, illustrating the area where the partition 13*d* extends.

Although the used developer G that has left the development roller 13*a* due to the magnetic force exerted by the release pole H3 is collected in the second transport chamber 32, the developer G collected in the second transport chamber 32 can move to the development roller 13*a* as indicated by an arrow shown in FIG. 6 as the second transport screw 13*b*2 rotates clockwise in FIG. 6.

Therefore, referring to FIGS. 2, 6, and 7, in the development device 13 according to the present embodiment, the partition 13*d* is disposed between the second transport screw 13*b*2 and the development roller 13*a* to prevent the developer G collected in the second transport chamber 32 from being resupplied to the development roller 13*a*. The partition 13*d* is configured to project from a surface of the interior wall 13*h* separating the first transport chamber 31 from the second transport chamber 32 to narrow the opening M, shown in FIG. 2, through which the second transport screw 13*b*2 faces the development roller 13*a*. It is to be noted that a shorter side of the partition 13*d* may be only such a length that the developer transported to the second transport chamber 32 from the development roller 13*a* through the opening M is not inhibited. In the configuration shown in FIG. 2, the partition 13*d* is not perpendicular to the circumferential surface of the development roller 13*a* but is substantially perpendicularly to a bottom surface of the interior wall 13*h*. The partition 13*d* is disposed in a portion of the bottom surface of the interior wall 13*h* closer to the development roller 13*a*.

The partition 13*d* is a nonmagnetic plate member including a nonmagnetic material such as nonmagnetic metal and/or resin. Thus, the partition 13*d* does not cause the magnetic carrier particles to adhere to the partition 13*d* magnetically, and thus the flow of the developer inside the second transport chamber 32 is not blocked.

With this configuration, even when the developer G collected in the second transport chamber 32 flies to the development roller 13*a* as the second transport screw 13*b*2 rotates, such developer G is blocked by the partition 13*d*. falling inside the second transport chamber 32. Thus, the used developer can be prevented from being resupplied from the second transport chamber 32 to the development roller 13*a* (resupply of used developer).

Because the partition 13*d* is disposed not to contact the development roller 13*a*, the partition 13*d* does not damage the development roller 13*a* or increase driving torque of the development device 13. Additionally, as shown in FIG. 6, the partition 13*d* is disposed upstream from the attraction position (e.g., attraction pole H4) and downstream from the release position (e.g. release pole H3) in the rotational direction of the development roller 13*a*. With this configuration, the above-described effects can be attained without inhibiting the developer supply to the development roller 13*a* due to the magnetic force of the attraction pole H4 and the release of developer from the development roller 13*a* due to the magnetic force of the release pole H3.

Additionally, as shown in FIGS. 4 and 7, the partition 13*d* is disposed adjacent to the second communication port 13*g*. More specifically, the partition 13*d* is disposed in the downstream portion of the second transport chamber 32, on the left in FIG. 4, because resupply of used developer can occur more easily in the downstream portion of the second transport chamber 32 where the surface of the developer is higher, that is, the amount of developer is greater, than in the upstream portion of the second transport chamber 32 where the surface of the developer is lower.

In other words, in the present embodiment, the partition 13*d* extends only in the area where resupply of used developer can easily occur in the longitudinal direction. This configuration can reduce the cost and weight of the development roller 13 *a* configuration in which the partition 13*d* extends across the entire longitudinal length of the second transport chamber 32.

Figure 8A:
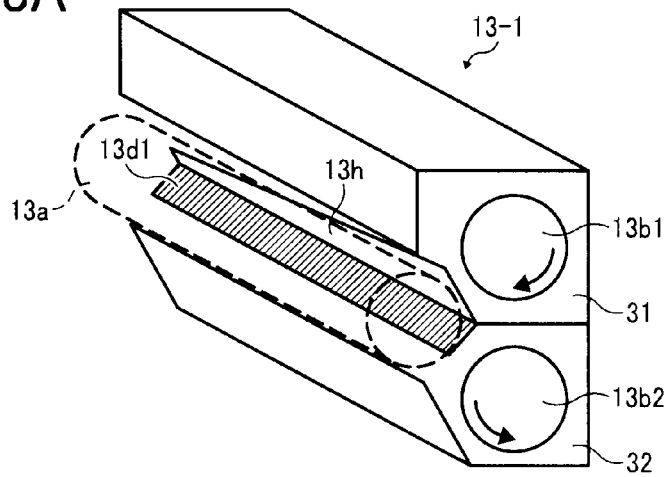
FIGS. 8A and 8B are perspective diagrams of development devices each including a partition whose configuration is different from that shown in FIG. 7.
Figure 8B:
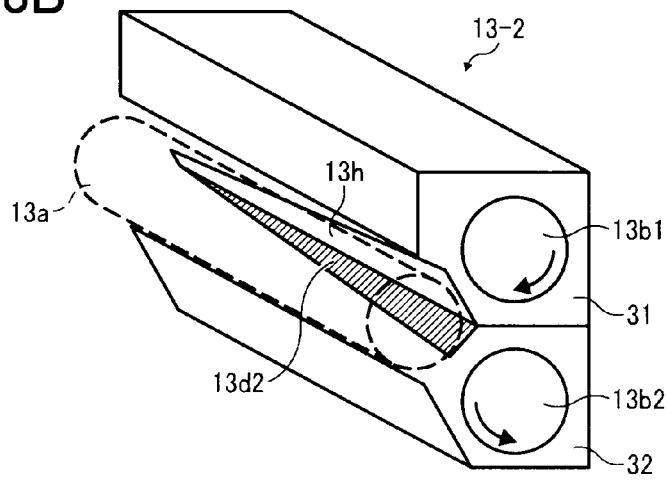

It is to be noted that the configuration of the partition 13*d* is not limited to that in the present embodiment but can be those shown in FIGS. 8A and 8B, for example.

FIGS. 8A and 8B are schematic diagrams respectively illustrating configurations of development devices 13-1 and 13-2. The development device 13-1 shown in FIG. 8A includes a partition 13*d*1 that extends across the entire longitudinal length of a second transport chamber 32. The development device 13-2 shown in FIG. 8B includes a partition 13*d*2 whose length of a shorter side (e.g., height) decreases gradually from the downstream side to the upstream side in a second transport chamber 32 although it extends across the entire second transport chamber 32 longitudinally similarly to the partition 13*d*1 shown in FIG. 8A. Also in these cases, the effects of the partition 13*d* can be maintained.

It is to be noted that, as shown in FIG. 7, the height of the vertically extending portion of the interior wall or jaw-like portion 13*h* of the first transport chamber 31 decreases gradually from the upstream side to the downstream side in the first transport chamber 31 in the developer circulation direction. This is because, as shown in FIG. 4, as the first transport screw 13*b*1 supplies the developer from the first transport chamber 31 to the development roller 13*a*, the surface of the developer in the first transport chamber 31 gradually decreases toward downstream in the developer circulation direction. Thus, the height of the jaw-like portion 13*h* decreases in accordance with the amount of the developer, which can facilitate reliable supply of the developer by the first transport screw 13*b*1 to the development roller 13*a*.

Further, referring to FIGS. 2, 4, and 6, in the present embodiment, the air discharge port 13*k* is formed in the second transport chamber 32 to exhaust air from the second transport chamber 32 outsize the development device 13. More specifically, the air discharge port 13*k* is a penetration hole formed in a wall of the second transport chamber 32, covered with a toner filter formed with a mesh member finer than the particle size of toner.

Although air enters the second transport chamber 32 as the development roller 13*a* rotates, the partition 13*d* inhibits the air from flowing out the second transport chamber 32. Accordingly, the pressure inside the second transport chamber 32 increases, slowing down the flow of the developer. However, even when the partition 13*d* is provided, the air discharge port 13*k* can reduce the increase in the pressure inside the second transport chamber 32, allowing the developer to flow smoothly in the second transport chamber 32.

Additionally, in the present embodiment, because the air discharge port 13*k* is covered with the toner filter, scattering of toner through the air discharge port 13*k* can be prevented. It is preferred that the air discharge port 13*k* be disposed at a position not to covered with the developer in the second transport chamber 32, that is, be disposed in an upper portion of the second transport chamber 32. Further, because the pressure in the second transport chamber 32 tends to increase in the area where the partition 13*d* extends, it is preferred that the position of the air discharge port 13*k* in the longitudinal direction be within the area where the partition 13*d* extends, that is, in the downstream portion of the second transport chamber 32 in the developer circulation direction as shown in FIG. 4.

Additionally, referring to FIGS. 5 and 6, in the present embodiment, the second transport screw 13*b*2 is configured so that the surface of the developer in the second transport chamber 32 is higher on the side away from the development roller 13*a* than on the side closer thereto, that is, the surface of the developer is higher on the left than on the right in FIGS. 5 and 6. More specifically, the second transport screw 13*b*2 is disposed to one side of the development roller 13*a* and configured to rotate downward in a position facing the development roller 13*a*, which is clockwise in FIGS. 5 and 6 and identical to the rotational direction of the development roller 13*a*. Therefore, the used developer G collected in the second transport chamber 32 after image development can be transported away from the development roller 13*a* (to the left in FIGS. 5 and 6) as the second transport screw 13*b*2 rotates. Accordingly, the developer G flows in the longitudinal direction in the second transport chamber 32 with its surface higher on the side away from the development roller 13*a* than on the side closer thereto. With this configuration, the developer flowing in the second transport chamber 32 is less likely to be resupplied to the surface of the development roller 13*a*.

Figure 9:
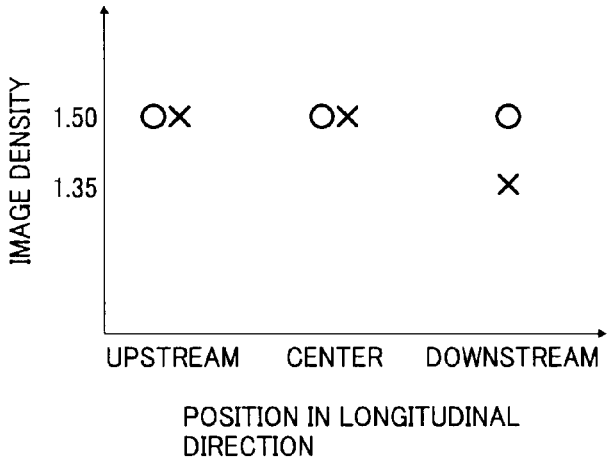
FIG. 9 is a graph illustrating results of an experiment performed to evaluate the effect of the partition on unevenness in image density.

FIG. 9 is a graph illustrating results of an experiment performed to evaluate the effect of the partition 13*d* on unevenness in image density.

In the experiment, solid images were formed on five sheets continuously using the development device 13 including the partition 13*d* according to the present embodiment and a comparative development device without the development device 13, and unevenness in image density was checked on the fifth sheet.

In FIG. 9, a horizontal axis represents the position in the output image in the longitudinal direction, which corresponds to the position in the second transport chamber 32, and a vertical axis represents image density measured with an X-Rite spectrophotometric color densitometer, type 938. In FIG. 9, "○" and "x" respectively represent the results obtained by the development device 13 according to the present embodiment and the comparative development device.

From the results shown in FIG. 9, it can be known that image density decreases at the position corresponding to the downstream portion of the second transport chamber 32 in the developer circulation direction when the partition 13*d* is not provided, and image density can be substantially equalized by providing the portion 13*d*. When the partition 13*d* was not provided, the used developer whose toner concentration was significantly reduced in developing the solid images was resupplied to the development roller 13*a* from the downstream portion of the second transport chamber 32 where the surface of the developer is higher, and the used developer was used in image development immediately at that position in the longitudinal direction.

As described above, providing the partition 13*d* can prevent or inhibit resupply of used developer, and accordingly unevenness in image density can be reduced.

The above-described configuration can be applied to not only the development device described with reference to FIGS. 2 through 9 but also other development devices such as those shown in FIGS. 10A and 10B.

Figure 10A:
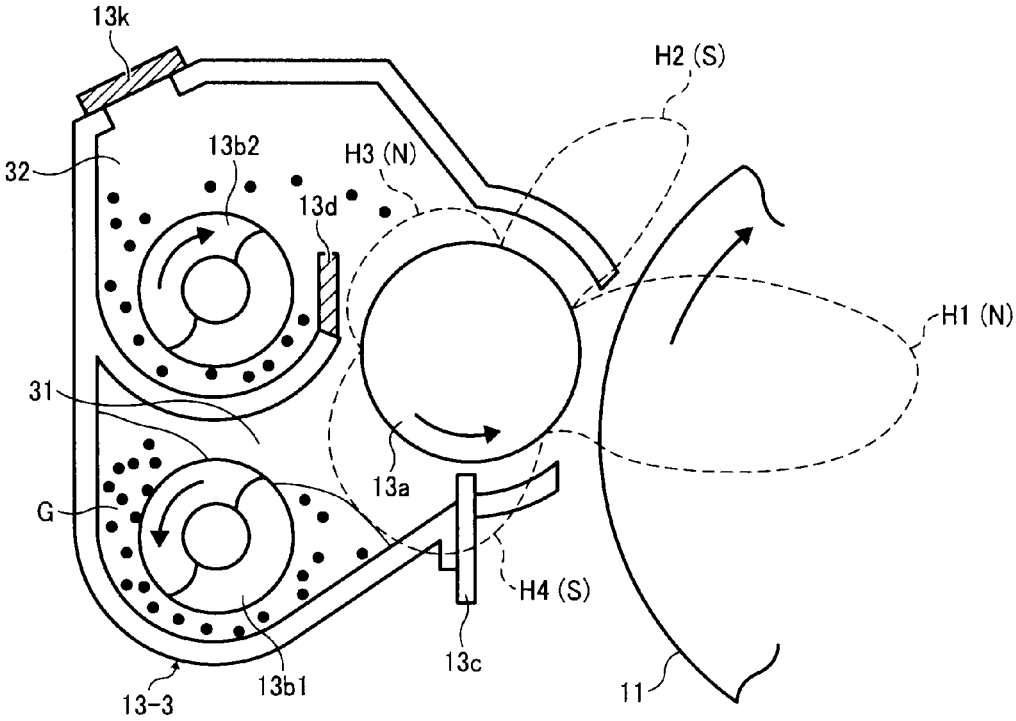
FIG. 10A is a schematic perspective diagram illustrating another configuration of the development device.

FIG. 10A illustrates a development device 13-3 in which the development roller 13*a* rotates counterclockwise, which is opposite the rotational direction of the development roller 13*a* shown in FIG. 2. More specifically, in the configuration shown in FIG. 10A, the development roller 13*a* and the photoconductor drum 11 rotate in the direction opposite to those in the configuration shown in FIG. 2. Accordingly, the doctor blade 13*c* is disposed beneath the development roller 13*a* and the first transport chamber 31 is disposed beneath the second transport chamber 32. In the configuration shown in FIG. 10A, the partition 13*d* is configured to extend between the development roller 13*a* and the second transport screw 13*b*2 from an edge portion of the interior wall dividing the interior of the development device 13-3. Although the partition 13*d* may be integrally formed on the interior wall, it is not necessary that the partition 13*d* is continuous with the interior wall.

Figure 10B:
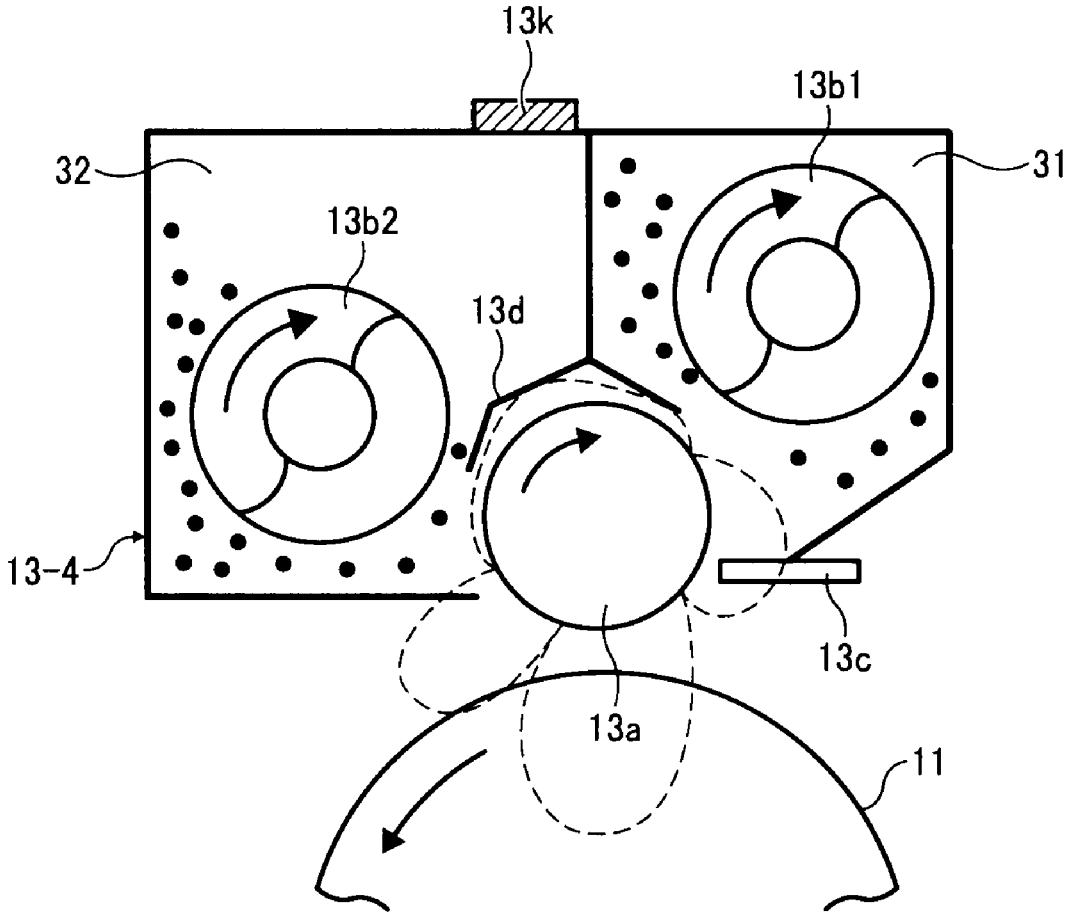
FIG. 10B is a schematic perspective diagram illustrating another configuration of the development device.

FIG. 10B illustrates a development device 13-4 in which the development device 13*a* is disposed above the photoconductor drum 11. In the configuration shown in FIG. 10B, the partition 13*d* extends between the development roller 13*a* and the second transport screw 13*b*2 from the interior wall, separating the first transport chamber 31 from the second transport chamber 32, that is angled to enclose the first transport screw 13*b*1. The partition 13*d* may be partly rounded to enclose the development roller 13*a*.

In these configurations, similarly to the configuration shown in FIG. 2, providing the partition 13*d* can prevent or inhibit resupply of used developer, and accordingly unevenness in image density can be reduced.

It is to be noted that, although the partition 13*d* projects from or be connected to the interior wall 13*h* in the above-described various configurations, the configuration of the partition 13*d* is not limited thereto as long as the partition 13*d* is disposed to extend between the development roller 13*a* and the second transport screw 13*b*2. For example, the partition 13*d* may extend from a side wall of the development device parallel to the surface of paper on which FIG. 2 is drawn.

As described above, in the present embodiment, the development device 13 includes two transport members (13*b*1 and 13*b*2) disposed facing the development roller 13*a* to transport the developer in the longitudinal direction, forming a circulation path through which the developer is circulated in the development device 13. The development device 13 further includes the partition 13*d* configured to extend between the development roller 13*a* and the second transport screw 13*b*2, thus preventing or inhibiting the used developer from being resupplied from the second transport chamber 32 to the development roller 13*a* without damaging the development roller 13*a*.

It is to be noted that, although only fresh toner is supplied from the toner container 28 to the development device 13 in the description above, alternatively, premixed fresh developer including toner and carrier particles may be supplied from a developer container to the development device 13. In this configuration, the development device 13 may further include a member to discharge excessive developer or used developer from the development device 13. In such a configuration, similar effects can be also attained.

Figure 11:
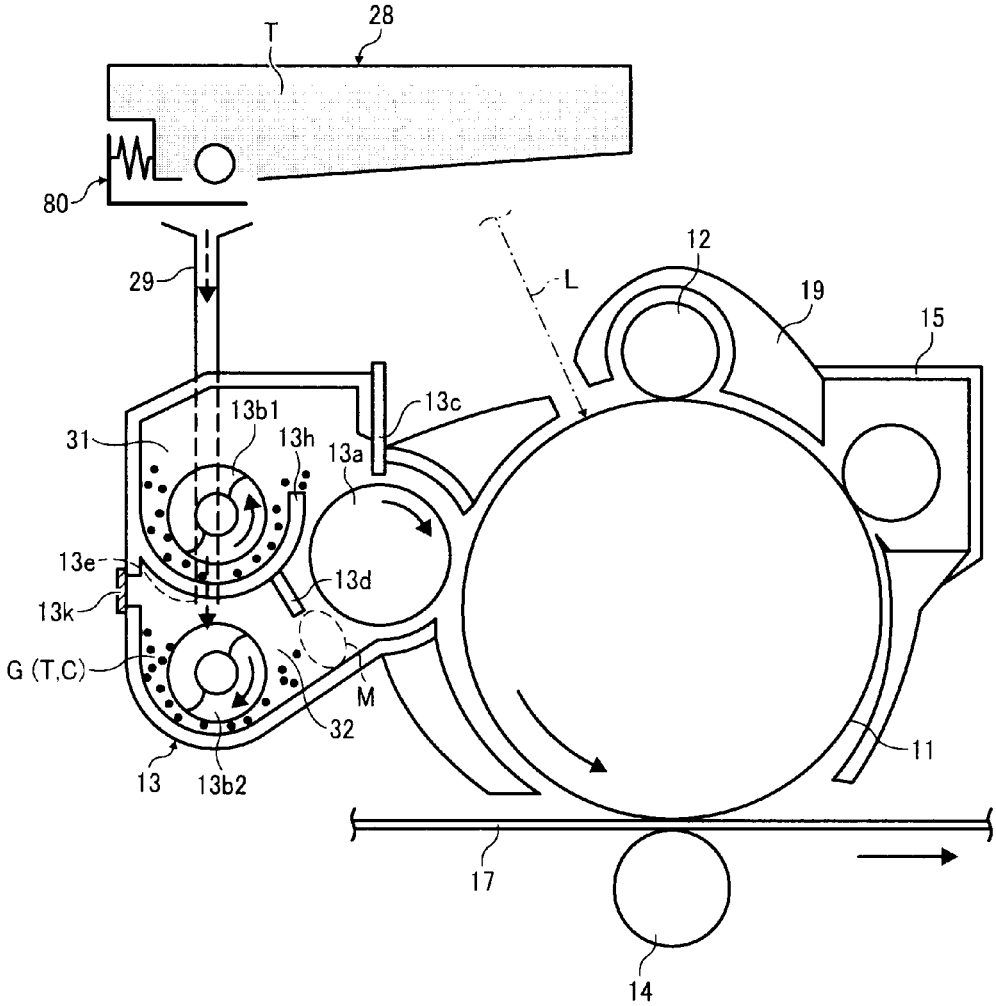
FIG. 11 illustrates a configuration of a process cartridge according to an illustrative embodiment.

FIG. 11 illustrates a configuration of a process cartridge according to an illustrative embodiment. In this specification, the process cartridge means a unit in which the photoconductor drum 11 and at least one of the charging member 12, the development device 13, and the cleaning unit 15 are united as a single unit removably installable in the image forming apparatus 1.

As shown in FIG. 11, the photoconductor drum 11, the charging member 12, the development device 13, and the cleaning unit 15 are held in a common casing 19 as a process cartridge that is removably installable in the image forming apparatus 1.

Alternatively, the development device 13 itself can be configured as a unit removably installable in the image forming apparatus.

Additionally, the number of the developer transport members (e.g., transport screws) are not limited to two but can be equal to or greater than three as long as at least two of them are disposed facing the development roller. In addition, the number of magnetic poles (e.g. H1 through H4) formed around the development roller is not limited to four. In configurations in which the number of magnetic poles is less than or greater than four, effects similar to those obtained in the above-described embodiments can be attained by providing the partition 13*d* between the development roller 13*a* and the second transport screw 13*b*2 in the second transport chamber (collection chamber) 32.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop a latent image formed on an image carrier with two-component developer consisting essentially of toner and magnetic carrier particles, the development device comprising:

a developer carrier disposed facing the image carrier, to carry the developer by rotation;

a magnetic field generator disposed inside the developer carrier, to form multiple magnetic poles around the developer carrier;

an interior wall that divides an interior of the development device into a first transport chamber and a second transport chamber parallel to the first transport chamber;

a first transport member disposed in the first transport chamber, facing the developer carrier, to supply the developer to the developer carrier while transporting the developer longitudinally within the development device;

a second transport member disposed in the second transport chamber, facing the developer carrier, to transport the developer separated from the developer carrier longitudinally within the development device; and a partition disposed between the developer carrier and the second transport member so as not to contact the developer carrier, and to prevent the developer in the second transport chamber from being supplied to the developer carrier, wherein a length of a shorter side of the partition, perpendicular to the longitudinal direction of the development device, decreases progressively from a downstream side to an upstream side in a direction in which the second transport member transports the developer.

2. The development device according to claim 1, wherein the partition projects from a surface of the interior wall to narrow an opening formed in the second transport chamber through which the second transport member faces the developer carrier.

3. The development device according to claim 2, wherein the partition projects from a bottom surface of the interior wall and is substantially perpendicular to the bottom surface of the interior wall.

4. The development device according to claim 2, wherein the partition is disposed on a side closer to the developer carrier on a bottom surface of the interior wall.

5. The development device according to claim 1, wherein, in a direction in which the developer carrier rotates, the partition is disposed upstream from an attraction position at which the developer is supplied to a circumferential surface of the developer carrier and downstream from a release position at which the developer is separated from the developer carrier.

6. The development device according to claim 1, wherein the partition is disposed in a downstream portion of the second transport chamber.

7. The development device according to claim 6, further comprising a communication port formed in the interior wall in the downstream portion of the second transport chamber, through which the downstream portion of the second transport chamber communicates with an upstream portion of the first transport chamber, wherein the partition is disposed adjacent to the communication port.

8. The development device according to claim 1, wherein the partition comprises a nonmagnetic material.

9. The development device according to claim 1, further comprising an air discharge port formed in the second transport chamber to discharge air from the second transport chamber outside the development device.

10. The development device according to claim 9, wherein the air discharge port is disposed in an upper portion within an area across which the partition extends in the longitudinal direction of the development device.

11. The development device according to claim 1, wherein the second transport member is disposed to one side of the developer carrier and rotates downward in a position facing the developer carrier to keep the surface of the developer inside the second transport chamber lower on a side closer to the developer carrier than on a side away from the developer carrier.

12. The development device according to claim 1, wherein the first transport member is disposed above the second transport member, the interior wall includes a vertically extending portion enclosing the first transport member, and a height of the vertically extending portion of the interior wall progressively decreases from an upstream side to a downstream side in a direction in which the first transport member transports the developer.

13. The development device according to claim 1, wherein the magnetic field generator forms multiple magnetic poles such that the developer forms a magnetic brush around the developer carrier, and wherein the edge of the partition does not contact the magnetic brush.

14. A process cartridge removably installable in an image forming apparatus, the process cartridge comprising:

an image carrier on which a latent image is formed; and a development device to develop the latent image formed on the image carrier with two-component developer consisting essentially of toner and magnetic carrier particles, the development device comprising:

a developer carrier disposed facing the image carrier, to carry the developer by rotation;

a magnetic field generator disposed inside the developer carrier, to form multiple magnetic poles around the developer carrier;

an interior wall that divides an interior of the development device into a first transport chamber and a second transport chamber parallel to the first transport chamber;

a first transport member disposed in the first transport chamber, facing the developer carrier, to supply the developer to the developer carrier while transporting the developer longitudinally within the development device;

a second transport member disposed in the second transport chamber, facing the developer carrier, to transport the developer separated from the developer carrier longitudinally within the development device; and a partition disposed between the developer carrier and the second transport member so as not to contact the developer carrier, and to prevent the developer in the second transport chamber from being supplied to the developer carrier, wherein a length of a shorter side of the partition, perpendicular to the longitudinal direction of the development device, decreases progressively from a downstream side to an upstream side in a direction in which the second transport member transports the developer.

15. The process cartridge according to claim 14, wherein the magnetic field generator forms multiple magnetic poles such that the developer forms a magnetic brush around the developer carrier, and wherein the edge of the partition does not contact the magnetic brush.

16. An image forming apparatus, comprising:

an image carrier;

a charging member disposed adjacent to the image carrier, to charge a surface of the image carrier;

a writing unit to direct an optical beam according to image date to the surface of the image carrier, forming a latent image thereon;

a development device to develop the latent image with two-component developer consisting essentially of toner and magnetic carrier particles, the development device comprising:

a developer carrier disposed facing the image carrier, to carry the developer by rotation;

a magnetic field generator disposed inside the developer carrier, to form multiple magnetic poles around the developer carrier;

an interior wall that divides an interior of the development device into a first transport chamber and a second transport chamber parallel to the first transport chamber;

a first transport member disposed in the first transport chamber, facing the developer carrier, to supply the developer to the developer carrier while transporting the developer longitudinally within the development device;

a second transport member disposed in the second transport chamber, facing the developer carrier, to transport the developer separated from the developer carrier longitudinally within the development device; and a partition disposed between the developer carrier and the second transport member so as not to contact the developer carrier, and to prevent the developer in the second transport chamber from being supplied to the developer carrier, wherein a length of a shorter side of the partition, perpendicular to the longitudinal direction of the development device, decreases progressively from a downstream side to an upstream side in a direction in which the second transport member transports the developer.

17. The image forming apparatus according to claim 16, wherein the magnetic field generator forms multiple magnetic poles such that the developer forms a magnetic brush around the developer carrier, and wherein the edge of the partition does not contact the magnetic brush.

* * * * *